US006708463B2

(12) United States Patent
Chai

(10) Patent No.: US 6,708,463 B2
(45) Date of Patent: Mar. 23, 2004

(54) METHOD AND APPARATUS FOR REPAIRING ROOF COVERING

(76) Inventor: King T. Chai, 3007 Santa Monica Blvd., Santa Monica, CA (US) 90404

( * ) Notice: Subject to any disclaimer, the term of this patent is extended or adjusted under 35 U.S.C. 154(b) by 0 days.

(21) Appl. No.: 10/084,739

(22) Filed: Feb. 25, 2002

(65) Prior Publication Data

US 2003/0159398 A1 Aug. 28, 2003

(51) Int. Cl.[7] ..... E04D 1/00; E04D 1/30

(52) U.S. Cl. ..... 52/748.1; 52/745.06; 52/90.2; 52/470; 52/530; 52/551; 52/556; 52/588.1

(58) Field of Search ..... 52/90.2, 478, 460, 52/461, 463, 467, 469, 470, 762, 765, 525, 530, 542, 551, 552, 556, 588.1, 592.1, 747.1, 745.06, 745.13, 748.1, 746.1, 520, 526, 544, 545, 546, 547

(56) References Cited

U.S. PATENT DOCUMENTS

| | | | | | |
|---|---|---|---|---|---|
| 511,859 | A | * | 1/1894 | Montross | 52/461 |
| 540,913 | A | * | 6/1895 | Hille | 52/277 |
| 1,126,114 | A | | 1/1915 | Spiegel | |
| 1,158,268 | A | | 10/1915 | Overbury et al. | |
| 1,162,949 | A | | 12/1915 | Schneider | |
| 1,251,950 | A | * | 1/1918 | Ames | 52/478 |
| 1,523,472 | A | | 1/1925 | Bobbit | |
| 1,638,755 | A | | 8/1927 | Tyra | |
| 2,100,505 | A | * | 11/1937 | Gimeno | 52/277 |
| 2,109,673 | A | | 3/1938 | McGee | |
| 2,520,499 | A | * | 8/1950 | Golaz | 52/460 |
| 2,936,723 | A | * | 5/1960 | Waldron | 52/460 |
| 3,485,002 | A | | 12/1969 | Baker | |
| 3,762,121 | A | | 10/1973 | Herman | |
| 3,855,753 | A | | 12/1974 | Terry | |
| 4,003,176 | A | | 1/1977 | Shumway | |
| 4,034,530 | A | | 7/1977 | Vallee | |
| 4,040,211 | A | | 8/1977 | Wotherspoon | |
| 4,058,950 | A | * | 11/1977 | Vallee | 52/461 |
| 4,084,365 | A | | 4/1978 | Read | |
| 4,145,860 | A | | 3/1979 | Wotherspoon | |
| 4,185,436 | A | | 1/1980 | Vallée | |
| 4,218,857 | A | | 8/1980 | Vallée | |
| 4,226,070 | A | | 10/1980 | Aragon | |
| 4,233,786 | A | | 11/1980 | Hildreth | |
| 4,251,967 | A | | 2/1981 | Hoofe, III | |
| 4,498,267 | A | | 2/1985 | Beck | |
| 4,716,701 | A | * | 1/1988 | Talbot | 52/536 |
| 5,423,157 | A | | 6/1995 | Watanabe | |
| 5,442,888 | A | | 8/1995 | Ilnyckyj | |
| 5,613,337 | A | | 3/1997 | Plath et al. | |
| 5,651,226 | A | * | 7/1997 | Archibald | 52/518 |
| 5,737,892 | A | | 4/1998 | Greenberg | |
| 5,845,446 | A | | 12/1998 | Funaki et al. | |
| 6,298,625 | B1 | | 10/2001 | Sweet | |
| 6,311,436 | B1 | * | 11/2001 | Mimura et al. | 52/173.3 |
| 6,354,045 | B1 | | 3/2002 | Boone et al. | |

FOREIGN PATENT DOCUMENTS

| | | | | | |
|---|---|---|---|---|---|
| JP | 2-232453 | A | * | 9/1990 | 52/518 |

* cited by examiner

*Primary Examiner*—Brian E. Glessner
(74) *Attorney, Agent, or Firm*—I. Michael Bak-Boychuk

(57) ABSTRACT

An assemblage of sheet metal roof covering pieces is utilized in a novel process to recover and stiffen a deteriorated roof without the necessity for extensive removal of the original roof covering, the deteriorated roof structure further stiffened by spaced stiffening ribs that also serve to fix in interlocked engagement the sheet metal roof covering pieces. Included in the assemblage are interlocking valley pans that are sequentially compressed between the ribs and then fastened with the valley pans then bridged by curved sheet metal caps that are also interlocked. The resulting structure has the pleasing appearance of an Oriental tile roof.

7 Claims, 4 Drawing Sheets

METHOD AND APPARATUS FOR REPAIRING ROOF COVERING

BACKGROUND OF THE INVENTION

1. Field of the Invention

The present invention relates to the method and structure for installing sheet metal roofing shingle arrays, and more particularly to the method and structure of mounting stamped sheet metal roof covering pieces conformed to interlock into exterior shapes reproducing the shape of oriental roofing tile and fastened onto reinforcing ribs.

2. Description of the Prior Art

Over long historic periods a roofing system has been practiced in China in which fired clay or ceramic valley pans are bridged at their adjacent edges by semicircular caps, resulting in a very distinct appearance. This roofing process, with some minor variations, has been adopted in the neighboring areas and is therefore now known by the familiar expression 'Oriental Roof'. With some frequency this oriental roof styling covers distinctly appearing building structures and it is therefore associated with distinct architectural motifs. The pleasing, well appreciated oriental styling motif obtains its visual underpinnings from the ribbed skeletal structure originally used to support the tile and the convolved shape is particularly useful in creating visual interest and distinctiveness in commonly designed building tracts. When implemented in traditional fired clay or ceramic tile, however, structures that have been appropriately ribbed and reinforced would be needed to accommodate this roofing weight and the ribbed roof exterior therefore suggests some structural efficacy. Recently, however, the construction techniques of frame housing prefer light weight over structural bulk and the interesting ornamental variety of this venerable roofing method has not had appropriate adaptation to our mode of life.

One constant process of life is the wear and damage that is universally sustained with time, including the wear and deterioration of the roofing shingles covering our buildings. As result a variety of roof coverings have been devised in the past that can be applied directly onto the most common roof covering, i.e., asphalt shingle, and these replacement roof coverings are now widely used. These, however, do little to improve the structure supporting the roof which very often also suffers some deterioration as the original roof covering fails. Amongst these are various forms of sheet metal shingle, also frequently applied directly on top of the existing asphalt tile, the substantially more rigid and durable aspects of a metal stamping being used to advantage to bridge and cover the deteriorating structure of the asphalt tile and also of its underlayment. Examples of stamped sheet metal roofing tile can be found in the teachings of U.S. Pat. No. 5,613,337 to Plath et al, U.S. Pat. Nos. 4,185,436 and 4,218,857 to Vallee, U.S. Pat. No. 6,298,625 to Sweet, U.S. Pat. No. 5,442,888 to Ilnyckyj and others. While suitable for the purposes intended, each of the foregoing examples describes a generally flat shingle structure which obtains structural stiffness only within the individual stamping itself and therefore lends little support over greater spans. For those instances where longer bridging spans are required, as in roof structures that show some deflection in the joists and beams themselves, little is available in the marketplace.

A convenient roof covering technique that includes structural reinforcement is extensively desired and it is one such technique that is described herein utilizing to advantage oriental roofing to accomodate reinforcement of structural beams.

SUMMARY OF THE INVENTION

Accordingly, it is the general purpose and object of the present invention to provide an assembly of sheet metal roof covering pieces which are useful with stiffening ribs applied in a novel process of recovering a roof.

Other objects of the invention are to provide a roof recovering method and structure in which the new roofing tile is installed in conjunction with stiffening ribs.

Yet additional objects of the invention are to provide a novel process for recovering roofs in which the roof covering includes reinforcing ribs.

Further objects of the invention are to utilize the ornamental aspects of an oriental roof covering to provide stiffening structure in the course of roof repair.

Briefly, these and other objects are accomplished within the present invention by providing a stamped sheet metal array of roof covering pieces which are affixed to a roof along with a set of generally parallel wood ribs, selected ones of which being aligned over the roof joists and rafters supporting the roof to provide stiffening thereto. The valleys between these ribs are then covered by stamped pans included in the inventive roofing array and the adjacent edges of the pans are bridged by semicircular caps arched over the subjacent ribs, thus replicating the exterior shape of an oriental roof Additional pieces of the array are then useful as end plugs closing the open cap ends, shaped blocks to cover the voids defined by each pan and other stampings for any necessary ridge covering and ridge connections. This assortment of pieces may be formed from relatively thin sheet metal such as galvanized sheet, aluminium or copper sheeting and may be coated, painted or otherwise colored to reproduce the color scheme of oriental roofing tile.

Preferably this combination of sheet metal pieces and the stiffening ribs is laid on top of a surface of roofing felt that is first positioned to cover the old roofing. Thus the ribs provide the further advantage of enhanced attachment of the roofing layers, reducing the incidents of peeling and tearing caused by weather and wind. In addition, the inventive recovering process entails bending of interlocking folds in the course of fastening thereof to the stiffening ribs, this bending process further improving structural integrity.

It will be appreciated that the ultimate shape of each cap and valley tile will be determined by the curling and bending thereof in the course of installation. The inventive process, therefore, is particularly suitable for existing structures that have distorted or settled with time effected by reproductions of old roof coverings which themselves varied in the course of their fabrication. Accordingly, the instant process is particularly suitable for the do-it-yourself practitioner.

DESCRIPTION OF THE PREFERRED EMBODIMENT

Figure 1:
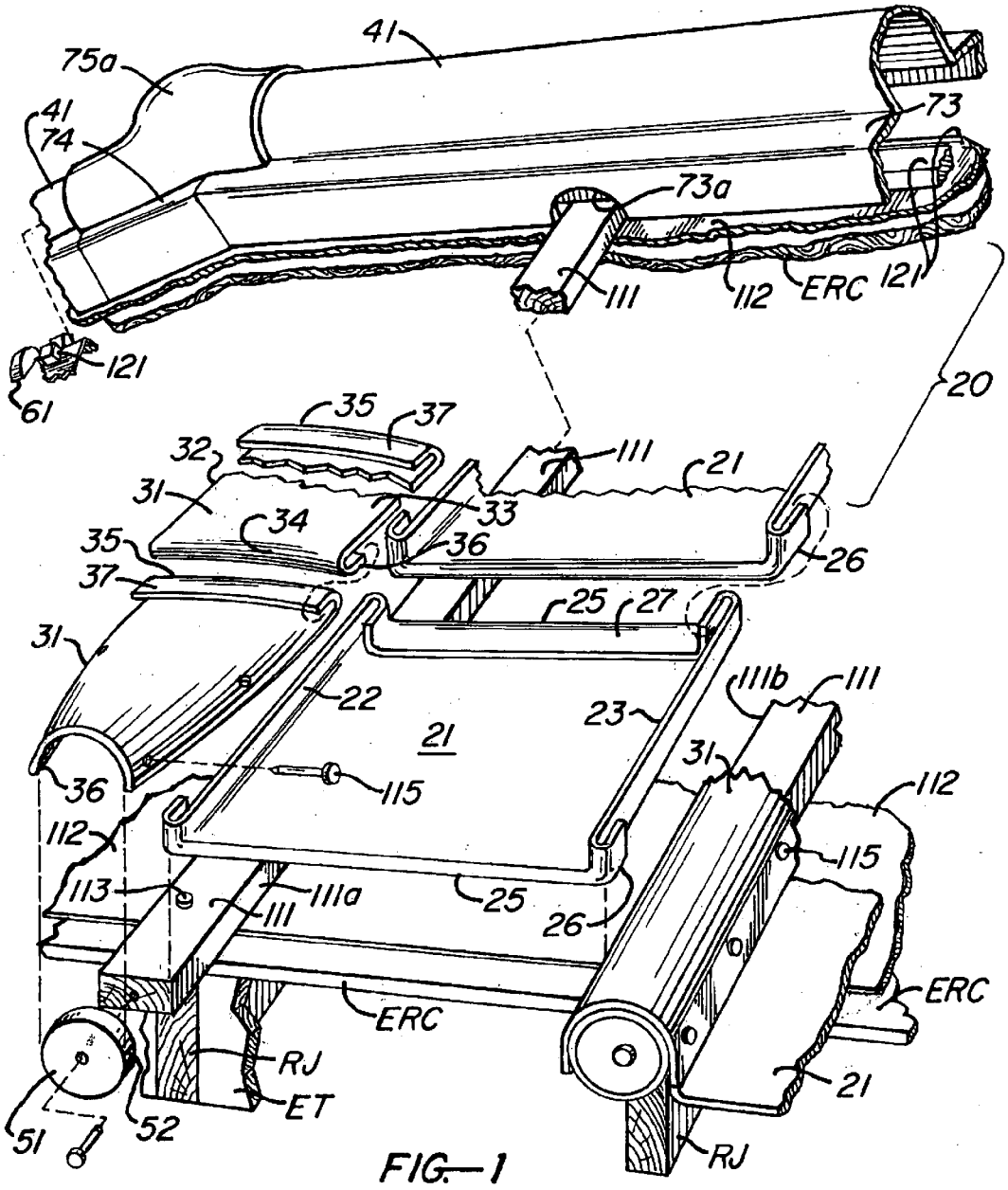
FIG. 1 is a perspective illustration, separated by parts, of the inventive roofing combination aligned to recover a previously covered roof.
Figure 2:
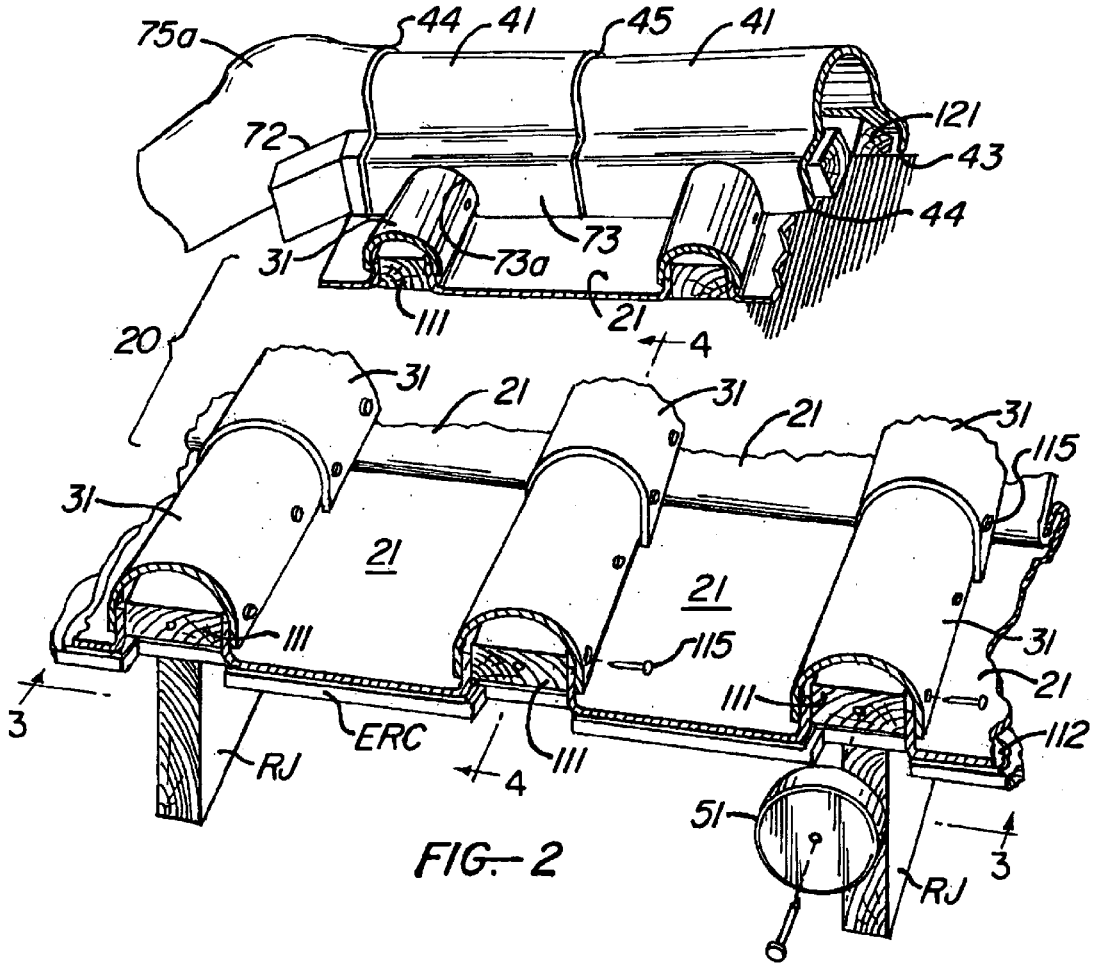
FIG. 2 is a further perspective illustration of the inventive roofing combination in its installed form.
Figure 3:
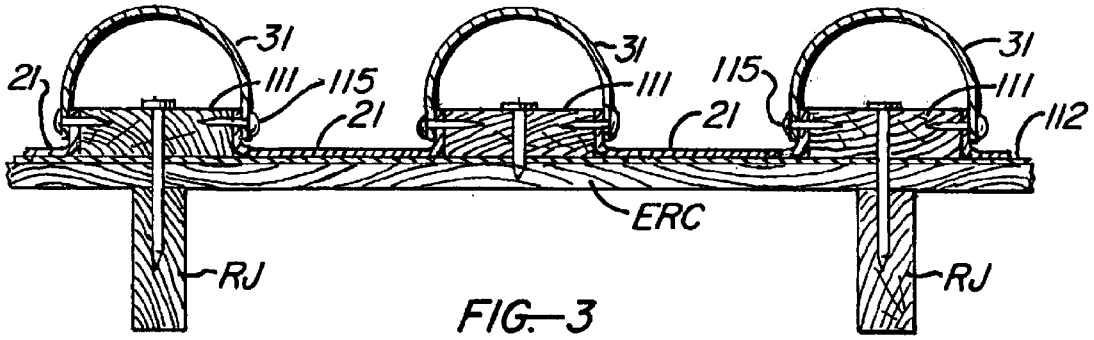
FIG. 3 is a sectional view of the inventive roofing combination taken along line 3—3 of FIG. 2.
Figure 4:
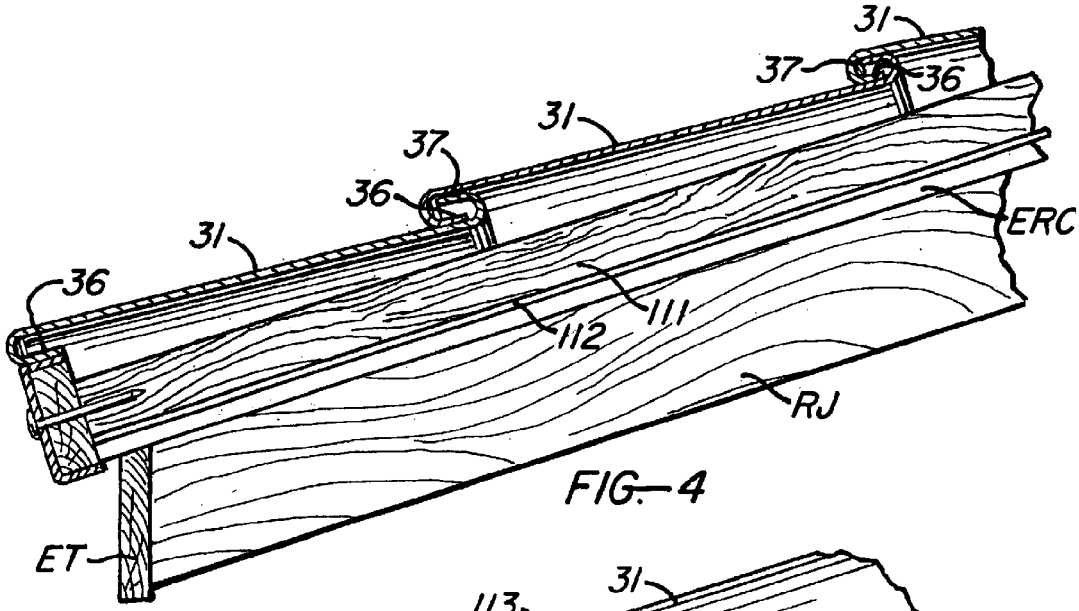
FIG. 4 is yet another sectional view of the inventive roofing combination taken along line 4—4 of FIG. 2.
Figure 5:
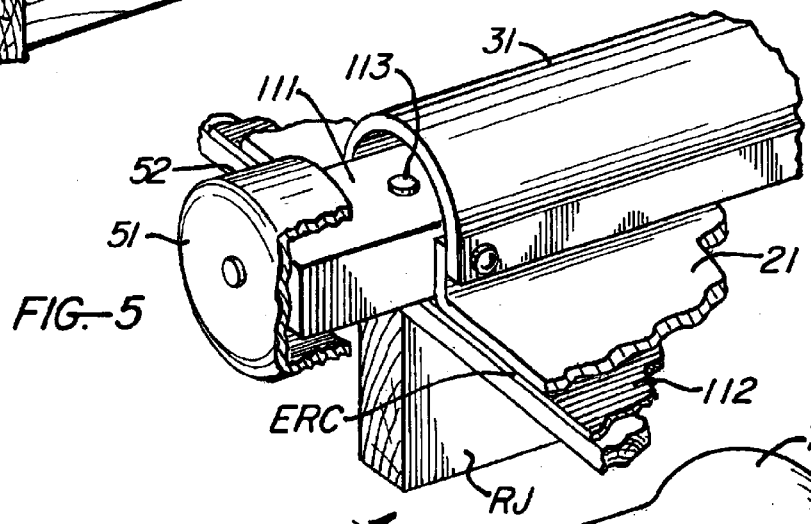
FIG. 5 is a detail illustration, in perspective and in partial section, of the end structure useful with the inventive roofing combination.
Figure 6:
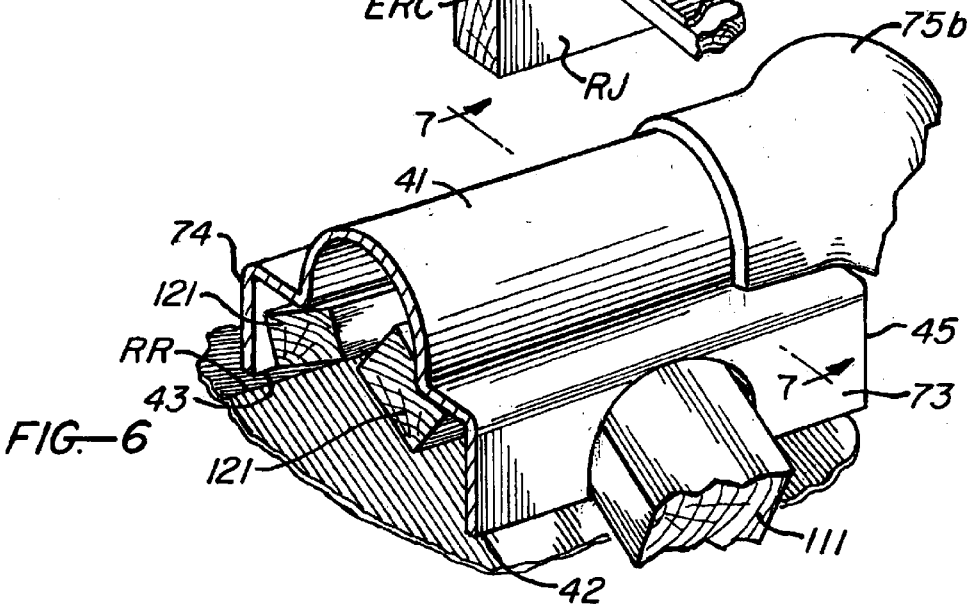
FIG. 6 is a further detail illustration, in perspective, of the ridge piece structure useful with the inventive roofing combination.
Figure 7:
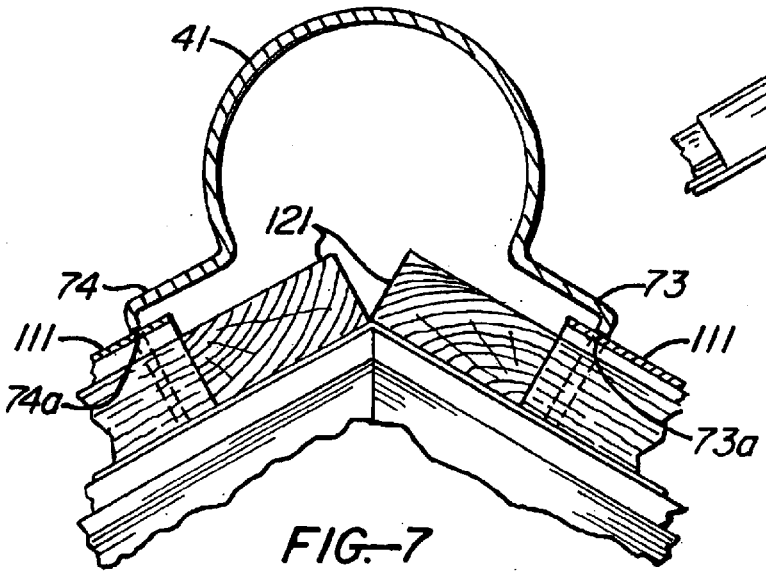
FIG. 7 is a sectional view taken along line 7—7 of FIG. 6 of the ridge piece useful with the inventive roofing combination.
Figure 8:
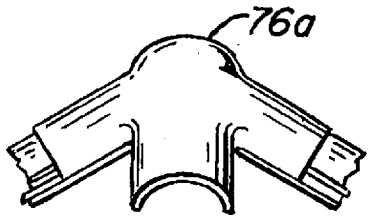
FIG. 8 is yet a further detail illustration, in perspective, of a ridge fairing useful with the inventive roofing combination.
Figure 9:
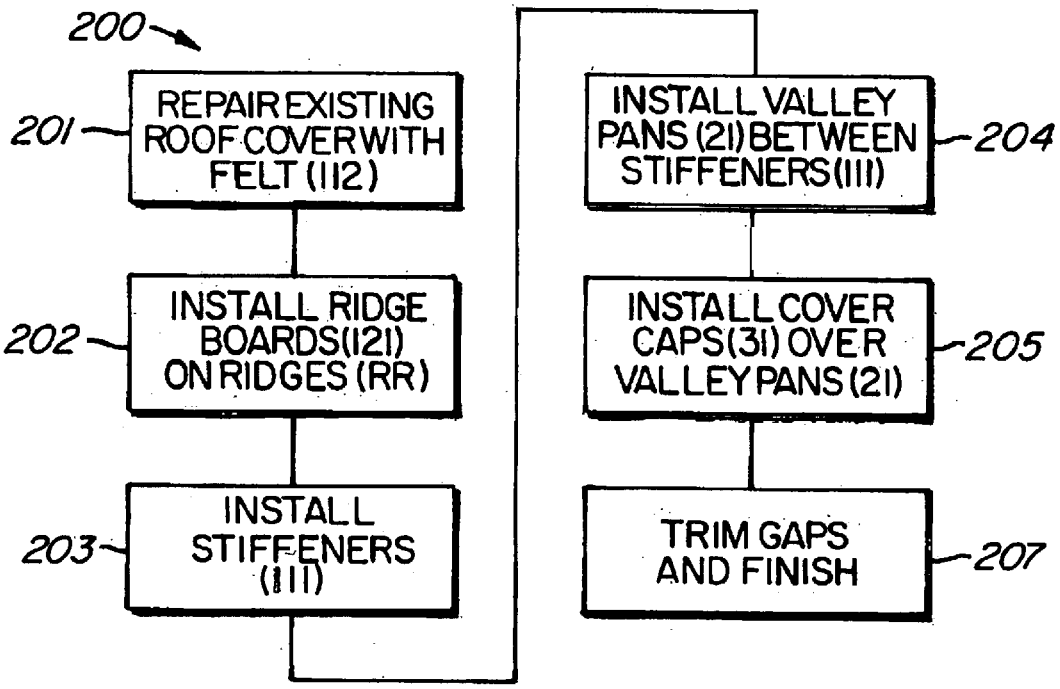
FIG. 9 is a sequence diagram of the steps comprising the inventive roofing process described herein.

As shown in FIGS. 1–8 the inventive sheet metal roofing array, collectively designated by the numeral 20, includes a plurality of formed sheet metal valley pans 21, a further plurality of sheet metal cover caps 31 and also a plurality of stamped ridge caps 41. Included further in the array are stamped, circular cover cap lids 51 and also semicircular ridge cap lids 61 for finishing off respectively the exposed ends of cover caps 31 and ridge caps 41. Provided further is an assortment of fairings, flashings and stops including ridge flashing 72, bird stops 73 and 74 and apex covers 75*a* and *b* and 76*a* and *b*. This complement of parts and components is useful with a vertically aligned set of stiffening ribs 111 in the form of conventional 2" by 4" nominal construction lumber that may be laid on top of a layer of roofing felt 112 rolled onto the existing roof covering ERC that, because of its wear, is to be recovered. To obtain the maximum structural benefit selected ones of the stiffening ribs 111 are aligned directly over the subjacent existing roof beams or rafters RJ and fastened thereto by way of long fasteners 113 extending all the way through the the stiffener, the felt layer, the exising roof covering and then into the beam. Depending on the spacing of the roofing framework one or more additional ribs 111 of similar construction lumber may be fastened to the roof between those fastened to the framework and each of the valley pans 21 are therefore dimensioned to accomodate an integer division of typical framework spacing.

Those in the art will appreciate that under current practice the roof beam spacing is typically 16 inch or 24 inch center to center. Each of the valley pans 21, therefore, is sized in width to about a 7 inch planform, allowing for an overlay of its lateral edges 22 and 23 onto the corresponding vertical surfaces 111*a* and *b* of the adjacent ribs 111, to be fastened thereto by nails or other fasteners 115. Longitudinally each valley pan 21 is dimensioned to a net dimension once again in integer units (e.g., two feet) defined two transverse edges 24 and 25 each including a corresponding fold 26 and 27 over the opposite pan surfaces for effecting a stepped interlock between the pans as they are fitted in a column up the valley covering the space between adjacent ribs. In each instance the lower edge of the upper pan that is interlocked with the one below it is forced down against the felt layer 112 and as so held the bent upwardly lateral edges 22 and 23 adjacent the interlock are nailed to the side surfaces 111*a* and *b* of the ribs 111, the overlying alignment resulting from the dimensional excess in the pan width. The fastened edges 22 and 23 on either side of each rib 111 are then covered and bridged by the arched caps 31, each cap again being defined by lateral edges 32 and 33 extending between transverse edges 34 and 35 formed by opposed folds 36 and 37 that are, once more, interlocked for a stepwise progression over each rib in a manner similar to the pans.

It will be appreciated that the foregoing installation process distorts in bending the folded transverse edges that are interlocked with the next valley pan or cap in each instance. Thus the installation sequence assists structural integrity by further crimping the interlock, thereby assuring better resistance to wind damage. Moreover, as each cap and valey pan is fastened to the ribs small adjustments can be effected in the curvature or edge bending to accomodate any settling and other distortion that is usually found in all existing structures. The inventive process, therefore, enhances both the resulting strength of sheet metal roof covering and the stiffness of the whole roof structure while also providing an interesting architectural variant of the finished roof covering.

To further enhance both the structural integrity and the visual appearance the lower ends of each of the ribs 111 may be covered by the circular lids 51 fitted subjacent the transverse edges of caps 31, each lid including a cylindrical skirt 52 formed in the course of its stamping. The sheet metal structure of the skirt is then trimmed and shaped to conform with any roof edge treatment ET and once so shaped may be affixed directly to the rib end by one or more nails 115. At the top end ridge boards 121 may be affixed on top of the felt 112 on both sides of each roof ridge RR to which the flashing 72 may be affixed and which thereafter may be covered an bridged by ridge caps 41, again defined by longitudinal edges 42 and 43 extending between transverse edges 44 and 45. As with caps 31 this interlocked row of ridge caps is curled to a tighter bend in the course of fastening to the ridge boards 121 by nails 115, thereby crimping the interlocked folds 76 and 77 for better structural engagement. The ends of these ridge cap rows may then be finished off by by one of the several apex covers 75*a*, 75*b*, or 76*a* depending on the roof configuration. Bird stops 73 and 74, each in the form of an L-sectioned sheet metal strip provided with semicircular cut-outs 73*a* or 74*a* in one leg thereof, can then be applied to cover any voids and overhangs formed by the ridge caps, the bird stops being formed to include cutouts 73*a* or 74*a* at various densities to accomodate various ridge alignments. Any open end voids in the cover caps 31 or ridge caps 41 can then be filled by the semicircular caps 61.

It will be appreciated that this inventive process and structure for effecting a sheet metal roof cover is particularly suited for those homeowners that would like to do it themselves. The process permits one to retain the integrity of the old roof covering, thereby permitting a piece-wise construction that creates little disruption in the use of the home being covered. Moreover, the process lends itself to all sorts decorative options and color schemes allowing the home owner the desired freedom of personal taste expression.

In each instance the inventive process 200 commences with the original roof covering that may be left in place, or may be removed in those sections that require repair, followed by a covering of a layer of roofing felt in step 201. The ridges RR are then trimmed with the ridge boards 121 in step 202 and thereafter the vertical stiffeners 111 are fastened to the roof in step 203 with those aligned over the original rafters fastened thereto. This skeletal structure both reinforces the original roof and also provides the attachments and alignment for the installation of the interlocked valley pan 21 in columns between the adjacent stiffeners, in step 204, which are then bridged by the cover caps 31 in step 205. In both the steps 204 and 205 substantial manual flexure of the individual pieces while such are fastened both assures a positive structural interlock and also accomodates structural distortions. Once this is done the remaining openiongs and gaps are then trimmed out in step 207. In this manner a conveniently effected covering technique is devised which replicates the distinct architectural motifs of oriental roofing.

Obviously many modifications and variations can be effected without departing from the spirit of the invention instantly disclosed. It is therefore intended that the scope of the invention be determined solely by the claims appended hereto.

It is claimed:

1. A method of repairing an existing cover on a pitched roof comprising the steps of:

covering said cover with a generally flexible sheet;

affixing a plurality of generally vertically aligned elongate ribs to the exterior of said roof and on top of said sheet selected ones of said ribs being aligned over beams supporting said roof;

interlocking longitudinally a plurality of sheet metal valley pans each of a generally rectangular planform of a width greater than the separation between said ribs, each said valley pan including opposedly folded over transverse edges for effecting a stepped interlock progression thereof;

compressing in sequence said interlocked valley pans into the space between the adjacent ones of said ribs and in the course of such compression progressively rolling the surface thereof so that commencing with the lower most the longitudinal edges of each said valley pan overlie in progressive sequence the sides of the adjacent ribs;

fastening said longitudinal edges of each said compressed valley pan to the proximate lateral surfaces of said adjacent ones of said ribs;

interlocking a plurality of sheet metal caps to each other in a longitudinal alignment, each said cap including opposedly folded over transverse edges for said effecting a stepped interlock progression; and bridging each said rib and the valley pan edges attached thereto with said caps by bending in progressive sequence each said cap in its interlocked alignment for attachment thereof to said ribs.

2. A method according to claim 1, comprising the further step of:

fixing a circular piece to each of the lower ends of said ribs subjacent the lower edge of said caps attached thereto.

3. A method for repairing an existing pitched roof comprising the steps of:

covering said roof with a generally flexible sheet;

affixing a plurality of generally equally spaced and vertically aligned elongate ribs to the exterior of said roof and on top of said sheet;

interlocking longitudinally in a stepped sequence a plurality of sheet metal valley pans each of a generally rectangular planform of a width greater than the separation between said ribs, each said valley pan including opposed transverse edge folds for interlocking with a correspondingly opposed edge fold of another valley pan;

compressing in sequence said interlocked valley pans into the space between the adjacent ones of said ribs and in the course of such compression progressively rolling the surface thereof so that commencing with the lower most the longitudinal edges of each said valley pan overlie in progressive sequence the sides of the adjacent ribs;

interlocking a plurality of sheet metal caps to each other in a longitudinal alignment; and bridging each said rib and the valley pan edges attached thereto with said caps by bending in progressive sequence each said cap in its interlocked alignment for attachment thereof to said ribs.

4. A method according to claim 3, comprising the further step of:

fixing a circular piece to each of the lower ends of said ribs subjacent the lower edge of said caps attached thereto.

5. A method according to claim 4 wherein:

the step of affixing said ribs on top of said roof includes the further step of aligning selected ones of said ribs over beams supporting said roof.

6. A method of re-covering an existing cover on a pitched roof, comprising the steps of:

covering said existing cover with a generally flexible sheet covering;

affixing a plurality of generally equally spaced and vertically aligned elongate ribs selected from standard dimension construction lumber to the exterior of said roof and on top of said sheet, selected ones of said ribs being aligned with the beams supporting said roof;

interlocking longitudinally in a stepped sequence a plurality of sheet metal valley pans each of a generally rectangular planform of a width greater than the separation between said ribs, each said valley pan including opposed transverse edge folds conformed for interlocking with the corresponding opposed edge fold in the next valley pan;

compressing in sequence the interlocked edge of each said valley pan into the space between the adjacent ones of said ribs and in the course of such compression progressively rolling the interlocked transverse edge and the adjacent surface thereof so that commencing with the lower most the longitudinal edges of each said valley pan overlie in progression the sides of the adjacent ribs;

fastening said longitudinal edges of each said compressed valley pan to the proximate lateral surfaces of the adjacent ones of said ribs;

interlocking a plurality of sheet metal caps to each other in a longitudinal alignment; and bridging each said rib and the valley pan edges attached thereto with said caps by bending each said cap in its interlocked alignment for attachment thereof to said ribs.

7. A method according to claim 6, comprising the further step of:

fixing a circular piece to each of the lower ends of said ribs subjacent the lower edge of said caps attached thereto.

* * * * *